US008706004B2

(12) United States Patent
Kamimura et al.

(10) Patent No.: US 8,706,004 B2
(45) Date of Patent: Apr. 22, 2014

(54) IMAGE FORMING APPARATUS HAVING TONER CARTRIDGE WITH MOVABLE SHUTTER

(71) Applicants: Naoya Kamimura, Ichinomiya (JP); Shougo Sato, Seto (JP); Masashi Imai, Kasugai (JP); Nao Itabashi, Nagoya (JP); Hideshi Nishiyama, Nagoya (JP); Ryuya Yamazaki, Nagoya (JP)

(72) Inventors: Naoya Kamimura, Ichinomiya (JP); Shougo Sato, Seto (JP); Masashi Imai, Kasugai (JP); Nao Itabashi, Nagoya (JP); Hideshi Nishiyama, Nagoya (JP); Ryuya Yamazaki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/893,314

(22) Filed: May 13, 2013

(65) Prior Publication Data

US 2013/0243477 A1 Sep. 19, 2013

Related U.S. Application Data

(63) Continuation of application No. 13/040,135, filed on Mar. 3, 2011, now Pat. No. 8,457,523.

(30) Foreign Application Priority Data

Mar. 5, 2010 (JP) ..... 2010-049433

(51) Int. Cl.
*G03G 21/18* (2006.01)

(52) U.S. Cl.
USPC ..... 399/112

(58) Field of Classification Search
USPC ..... 399/110, 111, 112, 119, 258, 262
See application file for complete search history.

(56) References Cited

U.S. PATENT DOCUMENTS 5,648,840 A * 7/1997 Ikunami et al. ..... 399/262
7,010,250 B1 3/2006 Yahagi
7,321,744 B2 * 1/2008 Hosokawa et al. ..... 399/258

(Continued)

FOREIGN PATENT DOCUMENTS

JP H08-015971 A 1/1996
JP H09-269639 A 10/1997

(Continued)

OTHER PUBLICATIONS

European Patent Office, Extended European Search Report for European Patent Application No. 11001742.3 (counterpart to co-pending U.S. Appl. No. 13/040,135), dated Jun. 6, 2011.

(Continued)

*Primary Examiner* — Robert Beatty
(74) *Attorney, Agent, or Firm* — Baker Botts L.L.P.

(57) ABSTRACT

An image forming apparatus includes a holder, photosensitive drums, developing units, and toner cartridges. Each toner cartridge includes a case, shutter, and operation member. The case contains the toner therein and has an opening at a position confronting the corresponding developing unit in a state that the toner cartridge is attached to the holder. The shutter is movable between a block position and an open position. The shutter is located at the open position when the operation member is located at a first position. The shutter is located at the block position when the operation member is located at a second position. The operation member has: a base end fixed to the shutter; and a distal end configured to move from a lower position to a position higher than the lower position when the operation member is moved from the first position to the second position.

23 Claims, 11 Drawing Sheets

(56) References Cited

U.S. PATENT DOCUMENTS

| | | | |
|---|---|---|---|
| 8,027,620 | B2 | 9/2011 | Sakuma |
| 8,229,318 | B2 | 7/2012 | Nakajima et al. |
| 2004/0223790 | A1 | 11/2004 | Hosokawa et al. |
| 2006/0067734 | A1 | 3/2006 | Igarashi et al. |
| 2007/0071494 | A1 | 3/2007 | Igarashi et al. |
| 2008/0080902 | A1 | 4/2008 | Saito et al. |
| 2008/0226331 | A1 | 9/2008 | Allen et al. |
| 2009/0297209 | A1 | 12/2009 | Nakajima et al. |
| 2011/0182612 | A1 | 7/2011 | Kamimura et al. |
| 2011/0182613 | A1 | 7/2011 | Kamimura et al. |

FOREIGN PATENT DOCUMENTS

| | | | |
|---|---|---|---|
| JP | H09-269716 | A | 10/1997 |
| JP | 2004-280064 | A | 10/2004 |
| JP | 2006-098772 | A | 4/2006 |
| JP | 2006-189675 | A | 7/2006 |
| JP | 2007-240575 | A | 9/2007 |
| JP | 2009-086289 | A | 4/2009 |
| JP | 2009-086417 | A | 4/2009 |
| JP | 2009-288473 | A | 12/2009 |
| WO | 2008/112973 | A1 | 9/2008 |

OTHER PUBLICATIONS

State Intellectual Property Office of the People's Republic of China, The First Office Action for Chinese Patent Application No. 201110058725.2 (counterpart to co-pending U.S. Appl. No. 13/040,135), mailed Sep. 29, 2012.

* cited by examiner

IMAGE FORMING APPARATUS HAVING TONER CARTRIDGE WITH MOVABLE SHUTTER

CROSS REFERENCE TO RELATED APPLICATION

This application is a continuation of U.S. application Ser. No. 13/040,135, filed Mar. 3, 2011, which claims priority from Japanese Patent Application No. 2010-049433 filed Mar. 5, 2010. The entire contents of each of the above noted applications are incorporated herein by reference.

TECHNICAL FIELD

The present invention relates to an image forming apparatus, such as a laser printer.

BACKGROUND

Typically, tandem color printers include four photosensitive drums for yellow, magenta, cyan, and black colors. These photosensitive drums, as a whole, can be attached to and detached from the main body casing of the color printer. This type of color printer includes a drawer frame capable of moving into and out from the main body casing. The four photosensitive drums are arranged on the drawer frame. The drawer frame is provided with four cartridge mounting portions corresponding to the respective photosensitive drums, on which toner cartridges are detachably disposed to be in one-to-one correspondence with the photosensitive drums. The toner cartridge includes a developing roller and contains toner therein. When the toner cartridge becomes empty with toner, the toner cartridge is removed from the drawer frame and replaced with a new one.

SUMMARY

Recently, manufacturers of consumable products have been required to achieve cost saving and environmental protection. To this end, in the case of running out of toner, it is desirable that a developing frame holding the developing roller is left in a drawer frame and only a toner cartridge containing the toner therein is replaced, rather than replacing a toner cartridge having a developing roller and all with a new one.

In such a system that only the toner cartridge can be replaced (toner cartridge replacing system), the toner cartridge is configured to be able to be attached to and detached from the developing frame. The toner cartridge is formed with an opening for supplying toner from the toner cartridge to the developing frame. Then, the toner cartridge is provided with a shutter for opening and closing the opening and for preventing the toner from spilling from the toner cartridge in a state that the toner cartridge is detached from the developing frame.

However, in the toner cartridge replacing system, after mounting a new toner cartridge to the developing frame, a user needs to operate the shutter to open the opening. If the user forgets this opening operation, an image forming operation cannot be performed since the toner is not supplied from the toner cartridge to the developing frame.

It is an object of the present invention to provide an image forming apparatus capable of surely preventing the toner cartridge from being accommodated in the main body casing in a state that the opening of the toner cartridge is blocked by the shutter.

This and other objects of the present invention will be attained by an image forming apparatus including a main body casing, a holder, a plurality of photosensitive drums, a plurality of developing units, and a plurality of toner cartridges. The holder is configured to move between an accommodated position where the holder is accommodated in the main body casing and a pulled out position where the holder is pulled out from the main body casing. The plurality of photosensitive drums is held by the holder and juxtaposed with each other with an interval between neighboring photosensitive drums. The plurality of developing units is held by the holder. Each of the plurality of developing units corresponds to each photosensitive drum to develop the corresponding photosensitive drum. The plurality of toner cartridges is configured to be attached to the holder when the holder is in the pulled out position. Each of the plurality of toner cartridges corresponds to one of the plurality of developing units to supply toner. Each of the toner cartridges includes a case, a shutter, and an operation member. The case is configured to contain the toner therein and has an opening at a position confronting the corresponding developing unit in a state that the toner cartridge is attached to the holder. The shutter is movable between a block position where the shutter blocks the opening and an open position where the shutter opens the opening. The operation member is used for operating the shutter such that the shutter moves between the block position and the open position. The shutter is located at the open position when the operation member is located at a first position. The shutter is located at the block position when the operation member is located at a second position different from the first position. The operation member has: a base end fixed to the shutter; and a distal end configured to move from a lower position to a higher position higher than the lower position when the operation member is moved from the first position to the second position.

BRIEF DESCRIPTION OF THE DRAWINGS

The particular features and advantages of the invention as well as other objects will become apparent from the following description taken in connection with the accompanying drawings, in which.

DETAILED DESCRIPTION

Next, an embodiment of the present invention will be described in detail with reference to the accompanying drawings.

1. Entire Configuration of a Printer

Figure 1:
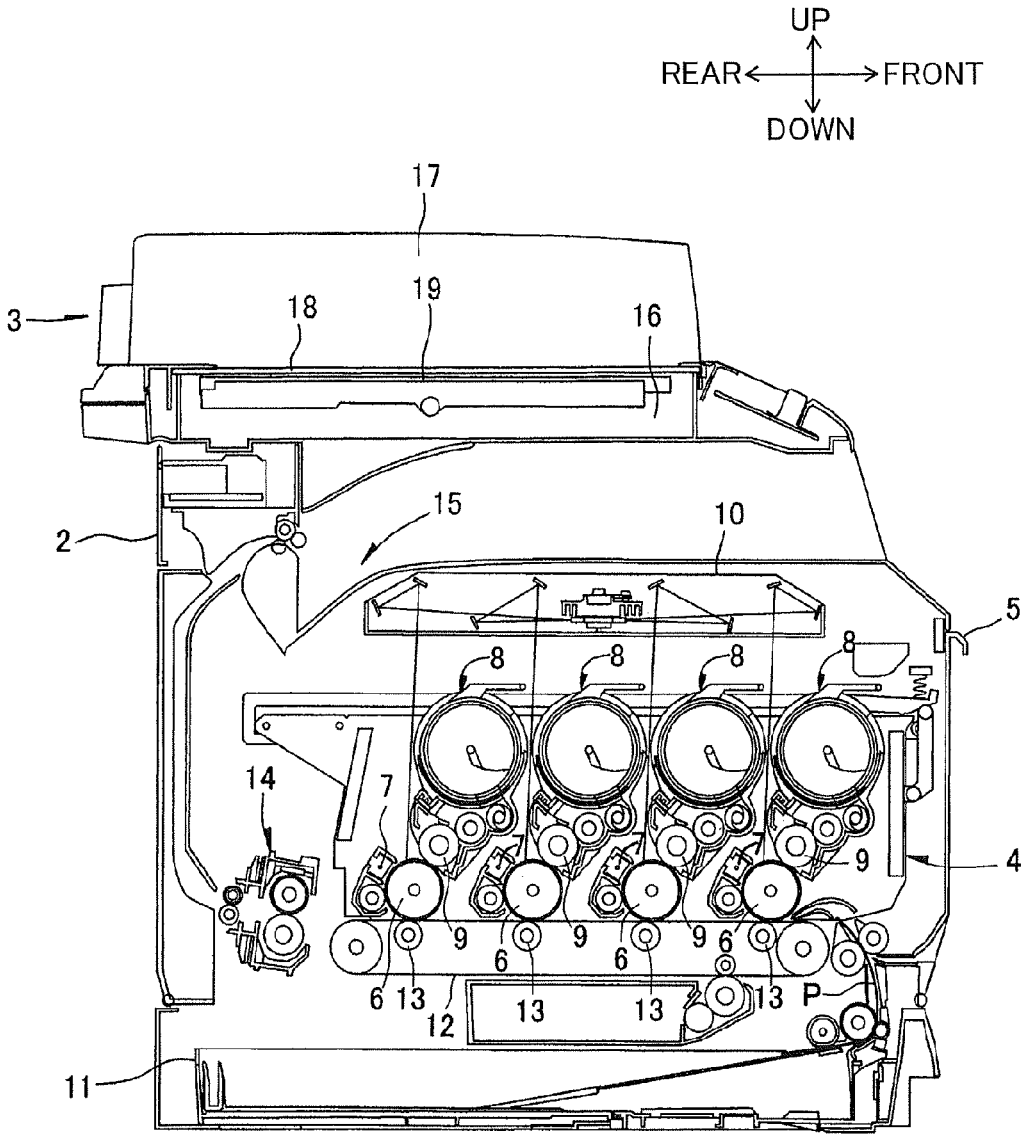
FIG. 1 is a side cross-sectional view showing a printer according to an embodiment of the present invention.

FIG. 1 is a side cross-sectional view showing a printer 1 according to an embodiment of the present invention. The printer 1 as an image forming apparatus includes a main body casing 2 formed in a box shape and a flatbed scanner 3 provided on the main body casing 2, and is a multifunction peripheral.

(1) Main Body Casing

The main body casing 2 is formed with an opening opened and closed by a front cover 5 provided at a side wall of the main body casing 2. A drum unit 4 as a holder unit is mounted on the main body casing 2. The drum unit 4 is movably mounted between a pulled out position where the drum unit 4 is pulled out from the main body casing 2 and an accommodated position where the drum unit 4 is accommodated in the main body casing 2. The terms "upward", "downward", "upper", "lower", "above", "below", "beneath" and the like will be used throughout the description assuming that the printer 1 is disposed in an orientation in which it is intended to be used. More specifically, in FIG. 1, a side of the front cover 5 (the right side in FIG. 1) will be referred to as "front side", and a side opposite to the front cover 5 will be referred to as "rear side". Further, the terms "right side" and "left side" will be used when viewed from the printer 1 from the front side.

The drum unit 4 includes four photosensitive drums 6 for the colors of black, yellow, magenta, and cyan, and arrayed in this order from the front side in the front-to-rear direction with an equal interval between neighboring photosensitive drums 6.

Further, in the drum unit 4, a scorotron charger 7 and a developer cartridge 8 as a developing unit are provided for each photosensitive drum 6. Each of developer cartridges 8 includes a developing roller 9 for supplying toner (developer) to the photosensitive drum 6. Each of the toner cartridges 8 is detachably assembled to the drum unit 4.

Above the drum unit 4, an exposure unit 10 is positioned for emitting four laser beams corresponding to the respective colors.

In accordance with the rotation of the photosensitive drum 6, the surface of the photosensitive drum 6 is uniformly charged by electrical charge from the scorotron charger 7. Then, the surface of the photosensitive drum 6 is selectively exposed by the laser beam from the exposure unit 10. Upon exposure, electrical charge on the surface of the photosensitive drum 6 is selectively erased to provide an electrostatic latent image on the surface of the photosensitive drum 6. Then, the toner is supplied to the electrostatic latent image from the developing roller 9, thereby forming a toner image corresponding to the latent image on the surface of the photosensitive drum 6. Incidentally, four LED arrays can be provided for the photosensitive drums 6 instead of the exposure unit 10.

At the bottom of the main body casing 2, a sheet cassette 11 is provided for accommodating therein a stack of sheets P. A conveyer belt 12 is provided immediately below the four photosensitive drum 6. Four transfer rollers 13 are positioned in confrontation with the photosensitive drums 6 interposing the conveyer belt 12 therebetween. A sheet P accommodated in the sheet cassette 11 is conveyed onto the conveyer belt 12 through feed rollers and the sheet P on the conveyer belt 12 is moved past the respective photosensitive drum 6 because of the running of the conveyer belt 12. Therefore, each toner image on each photosensitive drum 6 is transferred onto the sheet P because of the transfer bias applied to each transfer roller 13.

A fixing unit 14 is provided at a position downstream of the conveyer belt 12 in a sheet feeding direction. The sheet P carrying the toner image is conveyed to the fixing unit 14. The toner image on the sheet P is thermally and pressurizingly fixed to the sheet P by the fixing unit 14. A discharge tray 15 is provided downstream of the fixing unit 14 in the sheet feeding direction and at an upper surface of the main body casing 2. Image fixed sheet P is discharged onto the discharge tray 15 by way of discharge rollers.

(3) Flatbed Scanner

The flatbed scanner 3 includes a document rest 16 fixed on the main body casing 2 and a holding cover 17 pivotally supported to the document rest 16 through a hinge.

The document rest 16 is formed in a rectangular plate shape in a planar view. A platen glass 18 on which a document is placed is provided on the upper surface of the document rest 16. Inside the document rest 16, a CCD sensor 19 for reading an image of the document placed on the platen glass 18 is provided below the platen glass 18.

2. Toner Cartridge

Figure 2:
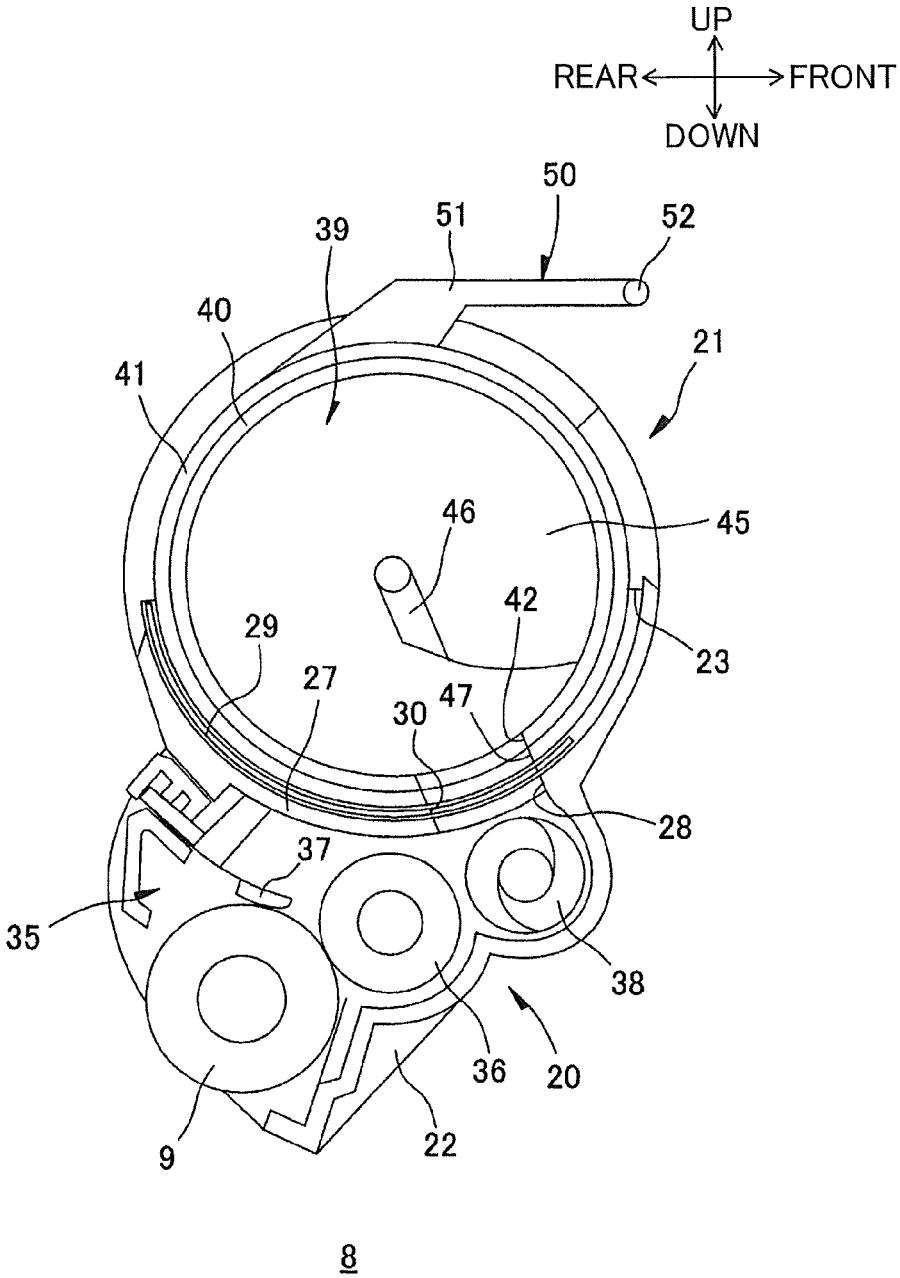
FIG. 2 is a cross-sectional view showing a toner cartridge in FIG. 1.

As shown in FIG. 2, the toner cartridge 8 includes a developing frame 20 supporting the developing roller 9 and is provided with a toner cartridge 21 detachably mounted on the developing frame 20.

(1) Developing Frame

Figure 3A:
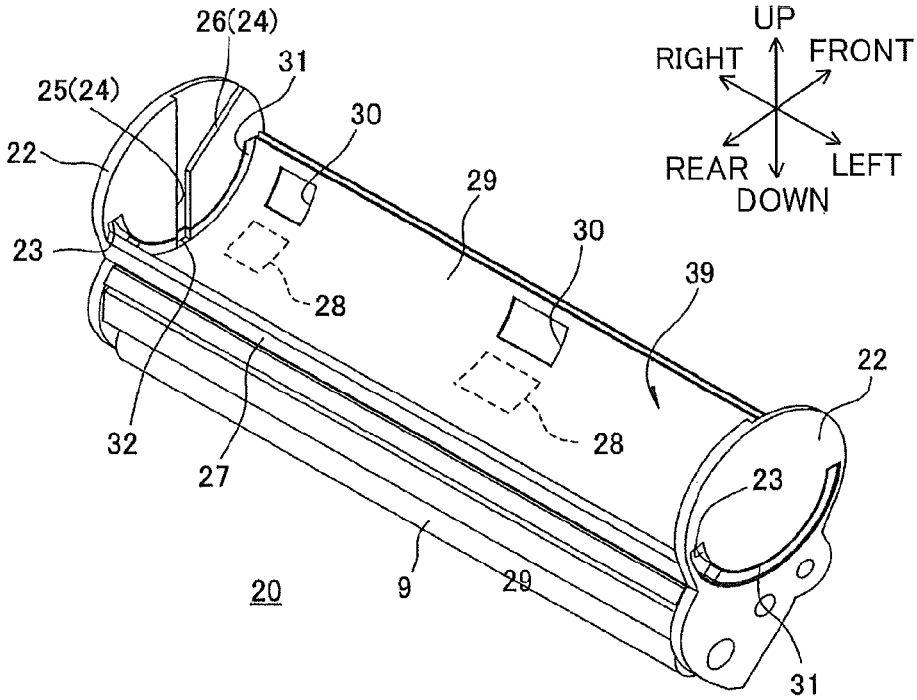
FIG. 3A is a perspective view showing a developing frame shown in FIG. 2 in which a first shutter is located at a block position.
Figure 3B:
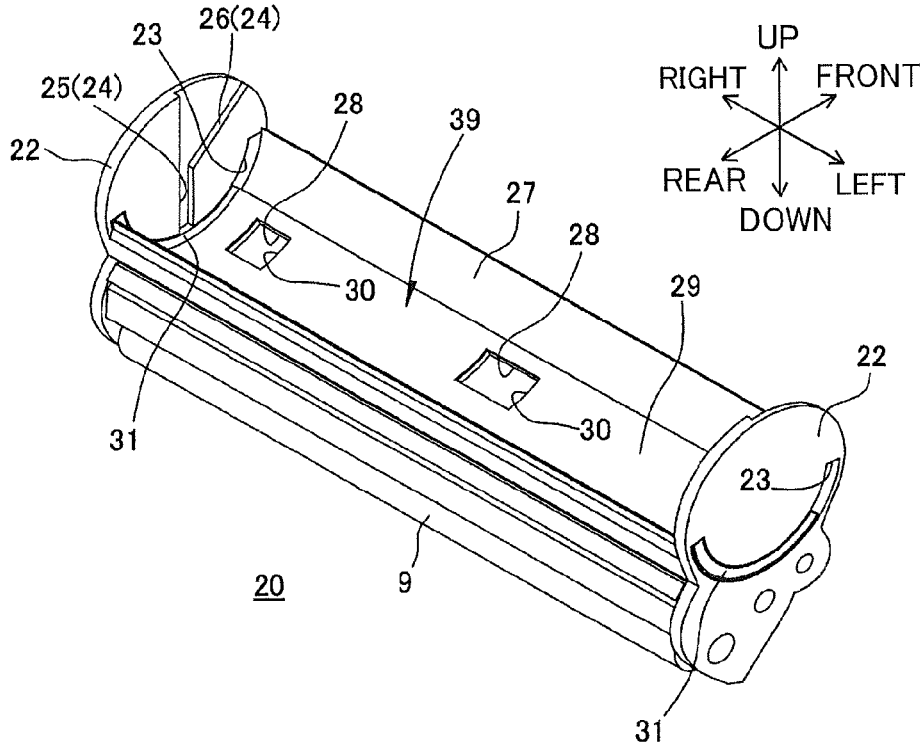
FIG. 3B is a perspective view showing the developing frame in which the first shutter is located at an open position.

As shown in FIGS. 3A and 3B, the developing frame 20 includes a pair of frame side plates 22 confronting with each other with a space in the left-to-right direction and a partition plate 27 provided between the pair of frame side plates 22 and extending in lest-to-right direction. The partition plate 27 has a circular arc shape in a lateral view so as to be convex downward. The partition plate 27 is positioned at a substantially central region of the frame side plates 22 in the vertical direction. A region between the pair of frame side plates 22 is divided into upper side and lower side regions by the partition plate 27. In the lower side region, a developing chamber 35 on which the developing roller 9 is positioned (see FIG. 2) is formed. In the upper side region, a cartridge mounting region 39 on which the toner cartridge 21 is detachably mounted is defined.

Each of the frame side plate 22 is formed with a slide guide portion 23 as a regulating member. Each of the slide guide portion 23 extends along the partition plate 27 and penetrates the corresponding frame side plate 22 in the left-to-right direction (the thickness direction of the frame side plate 22).

Further, each of the frame side plate 22 is formed with a mounting guide portion 24 extending upward from a center of the side guide member 23 in a circumferential direction of the partition plate 27. The mounting guide portion 24 has a groove shape formed by depressing the inner surface of the frame side plate 22. The mounting guide portion 24 has an extending portion 25 extending upward from the slide guide portion 23 with a fixed width and a guide portion 26 connected to an upper end of the extending portion 25 and having a fan shape spreading upward and frontward from the upper end of the extending portion 25.

As indicated by a dashed line in FIG. 3A, the partition plate 27 is formed with three first communication openings 28 each having rectangular shape at positions displaced from the center of the partition plate 27 in the circumferential direction thereof toward the rear side. The first communication openings 28 are arrayed in the left-to-right direction with an interval between neighboring first communication openings 28. Note that, FIGS. 3A and 3B show only two of three first communication openings 28.

Further, a first shutter 29 is provided between the pair of frame side plates 22 at the upper side region of the partition plate 27. The first shutter 29 has a circular arc shape and extends along the inner surface of the partition plate 27.

The first shutter 29 has a length in the circumferential direction smaller than that of the partition plate 27 and a width in the left-to-right direction substantially the same as that of the partition plate 27. At both ends of the first shutter 29 in the left-to-right direction, ribs 31 are provided throughout an entire region of the first shutter 29 in the circumferential direction of the partition plate 27. Each of the ribs 31 radially and inwardly protrudes from the first shutter 29 and is positioned inside the slide guide portion 23 formed at the frame side plate 22. Hence, the first shutter 29 is slidably supported by the pair of frame side plates 22 in the circumferential direction of the partition plate 27. Further, as shown in FIG. 3A, the rib 31 is formed with a notched portion 32.

The first shutter 29 is formed with three first shutter openings 30 each having substantially the same shape as the first communication openings 28. The first shutter openings 30 are located at positions corresponding to the first communication openings 28 in the left-to-right direction. As shown in FIG. 3A, when the front end part of the first shutter 29 is in confrontation with the front end part of the partition plate 27 in a radial direction of the partition plate 27, the respective first shutter openings 30 are located at a position anterior to the first communication openings 28. In this state, the first shutter 29 is positioned at a block position where the first shutter 29 blocks the first communication openings 28. Further, as shown in FIG. 3B, when the rear end part of the first shutter 29 is in confrontation with the rear end part of the partition plate 27 in the radial direction of the partition plate 27, each of the first shutter openings 30 communicates with the corresponding first communication opening 28. In this state, the first shutter 29 is positioned at an open position where the first shutter 29 opens the first communication openings 28.

As shown in FIG. 3A, when the first shutter 29 is located at the block position, the notched portion 32 is in confrontation with the extending portion 25 so as to be in communication with the extending portion 25.

As shown in FIG. 2, in the developing chamber 35, the developing roller 9, a supply roller 36, a layer thickness regulating blade 37, and a screw auger 38 are provided.

The developing roller 9 extends in the left-to-right direction and is rotatably supported by the developing frame 20. A part of the outer circumferential surface of the developing roller 9 is exposed from the developing frame 20 to rearward and downward. When the toner cartridge 8 is assembled to the drum unit 4 (see FIG. 1), a part of the developing roller 9 that is exposed from the developing frame 20 is in contact with the outer circumferential surface of the photosensitive drums 6.

The supply roller 36 extends in the left-to-right direction and is rotatably supported by the developing frame 20. The supply roller 36 is positioned at the lower rear side of the first communication openings 28 and is in pressed contact with the developing roller 9 from the upper front side thereof.

The layer thickness regulating blade 37 has a base portion and a tip portion. The base portion of the layer thickness regulating blade 37 is fixed to the rear side portion of the developing frame 20. The tip portion of the layer thickness regulating blade 37 contacts with the outer circumferential surface of the developing roller 9 with pressure.

The screw auger 38 extends in the left-to-right direction, is positioned at the lower side of the first communication openings 28, and is rotatably supported on the developing frame 20.

When the toner cartridge 8 is mounted on the main body casing 2, the developing roller 9, the supply roller 36, and the screw auger 38 are arrayed substantially on one straight line, and the first communication openings 28 are positioned above the screw auger 38.

(2) Toner Cartridge

Figure 4A:
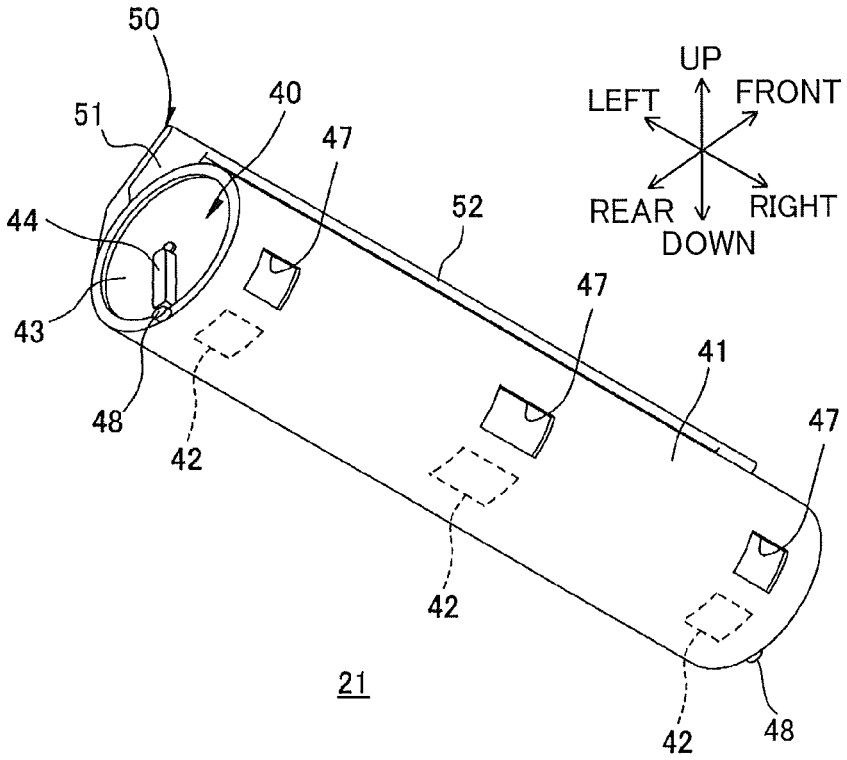
FIG. 4A is a perspective view showing a toner cartridge shown in FIG. 2 in which a second shutter is located at a block position.
Figure 4B:
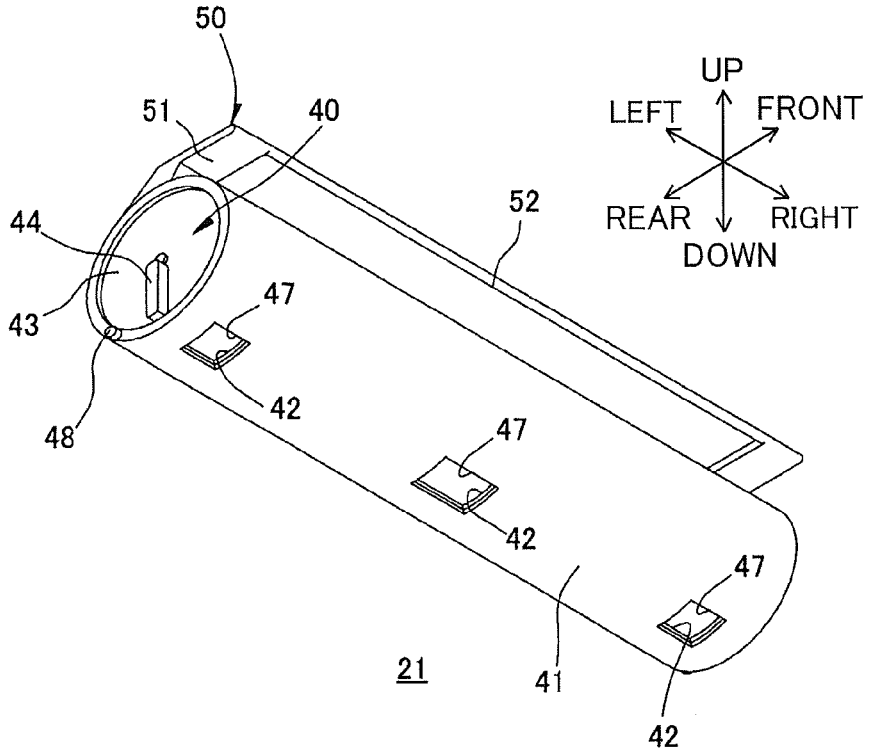
FIG. 4B is a perspective view showing the toner cartridge in which the second shutter is located at an open position.

As shown in FIGS. 4A and 4B, the toner cartridge 21 includes a main body portion 40 as a case and a second shutter 41 as a shutter accommodating the main body portion 40 therein. Each of the main body portion 40 and the second shutter 41 has a cylindrical shape. The main body portion 40 has an outer diameter slightly smaller than the inner diameter of the second shutter 41. Hence, the main body portion 40 is surrounded by the second shutter 41.

As indicated by a dashed line in FIG. 4A, the main body portion 40 is formed with three second communication openings 42 as an opening each having rectangular shape. The second communication openings 42 are arrayed in the left-to-right direction with an interval between neighboring first communication openings 28 (an axial direction of the main body portion 40). Each of the second communication openings 42 is formed at substantially the same size as the first communication opening 28 (see FIG. 3A).

Both ends of the main body portion 40 in the left-to-right direction are sealed by disk-shaped sealing plates 43. A regulating protrusion 44 is provided on the outer surface of the sealing plate 43. The regulating protrusion 44 outwardly projects from the sealing plate 43. The regulating protrusion 44 extends from the center of the sealing plate 43 in a radial direction of main body portion 40 and is formed throughout the entire length of the radius of the sealing plate 43. Further, the regulating protrusion 44 has substantially the same width as the extending part 25 (see FIG. 3A) of the mounting guide part 24.

As shown in FIG. 2, the inner space of the main body portion 40 defines a containing chamber 45 containing the toner. An agitator 46 for agitating the toner is provided in the containing chamber 45.

The agitator 46 is located on the vertical line right above the supply roller 36, and the developing chamber 35 is arranged with the toner cartridge 21 in the vertical direction.

The second shutter 41 is provided so as to move slidably with respect to the main body portion 40 in the circumferential direction thereof. The second shutter 41 is formed with three second shutter openings 47 each having substantially the same shape as the second communication openings 42. The second shutter openings 47 are located at positions corresponding to the second communication openings 42 in the left-to-right direction.

Further, a grip portion 50 as an operation member is provided on the second shutter 41 at a side opposite to the second shutter openings 47 with respect to the central axis of the second shutter 41. That is, the central axis of the second shutter 41 is positioned between the grip portion 50 and the second shutter openings 47. The grip portion 50 integrally includes a pair of supporting portion 51 and a connecting portion 52. The pair of supporting parts 51 has a plate shape, each extends from the outer circumferential surface of the second shutter 41 and is positioned at each end portion of the second shutter 41 in the left-to-right direction. The tip portions of the supporting parts 51 are connected with each other through the connecting part 52. The grip part 50 extends in a direction away from the second shutter 41.

As shown in FIG. 4A, a pair of engaging protrusions 48 is provided at both ends of the second shutter 41 in the left-to-right direction. Each of the engaging protrusion 48 is in confrontation with the outside (the side opposite to the center side) end part of the regulating protrusion 44 in the radial direction of the main body portion 40 and outwardly projects from the both ends of the second shutter 41. The engaging protrusion 48 has substantially the same size (width) as the notched portion 32 (see FIG. 3A) of the first shutter 29. In this state, the second shutter openings 47 are located at positions displaced from the second communication openings 42 in the circumferential direction of the main body portion 40. In other words, the second shutter openings 47 is not in confrontation with the second communication openings 42 in the radial direction of the main body portion 40. In this state, the second shutter 41 is positioned at a block position where the second shutter 41 blocks the second communication openings 42.

Further, as shown in FIG. 4B, when the engaging protrusion 48 is located at a position displaced from the regulating protrusion 44 in the circumferential direction of the main body portion 40, the second shutter openings 47 are located at positions in confrontation with the second communication openings 42 in the radial direction of the main body portion 40. In this state, the second shutter 41 is positioned at an open position where the second shutter 41 opens the second communication openings 42.

A sealing member (not shown) for preventing the toner from spilling at the periphery of the second communication openings 42 and the second shutter openings 47 is inserted between the main body portion 40 and the second shutter 41 in a compressed state. The sealing member has, for example, a known configuration such as a sponge.

3. Drum Unit

Figure 5:
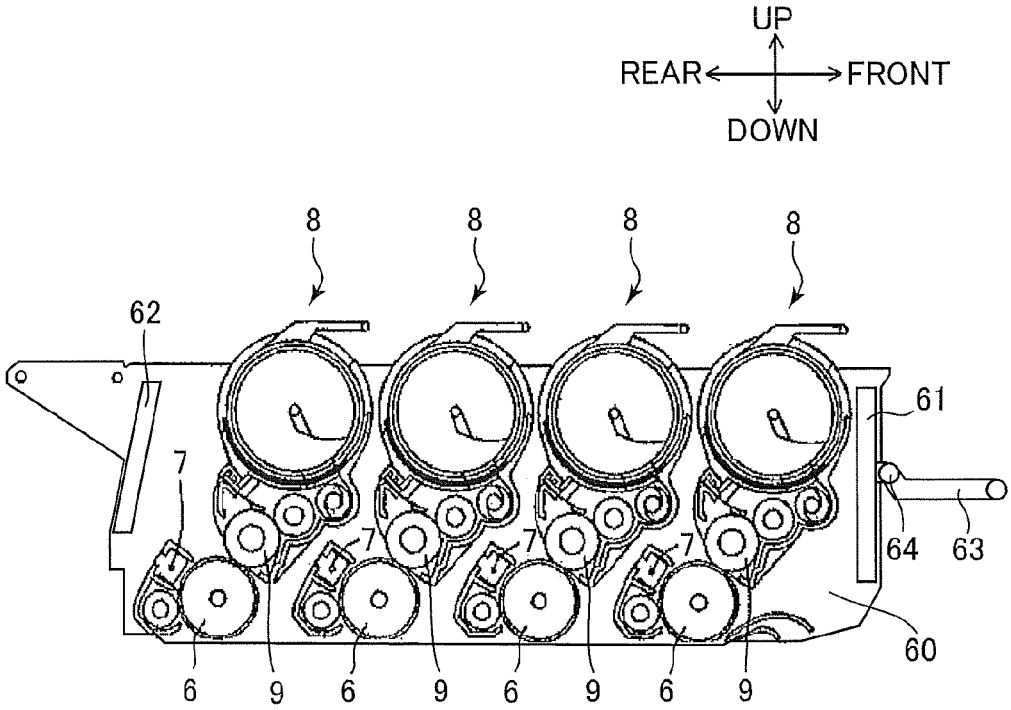
FIG. 5 is a cross-sectional view showing a drum unit shown in FIG. 1.

As shown in FIG. 5, the drum unit 4 includes a pair of drum side plates 60, a front beam 61, and a rear beam 62. The pair of drum side plates 60 is in confrontation with each other with a space in the left-to-right direction. The front beam 61 extends in the left-to-right direction and connects the front end portion of one drum side plate 60 to the front end portion of another drum side plate 60. The rear beam 62 extends in the left-to-right direction and connects the rear end portion of one drum side plate 60 to the rear end portion of another drum side plate 60.

Each of the drum side plate 60 is formed in a plate shape extending in the front-to-rear direction and the vertical direction, and collectively supports the four photosensitive drums 6 and the scorotron chargers 7. Further, flange portions (not shown) are provided at the upper end portions of the drum side plates 60, respectively. Each of the flange portions extends in the front-to-rear direction and projects laterally outwardly from the drum side plate 60. A roller (not shown) rotatable about a shaft extending laterally is provided at the rear end portion of the flange portion.

Figure 11:
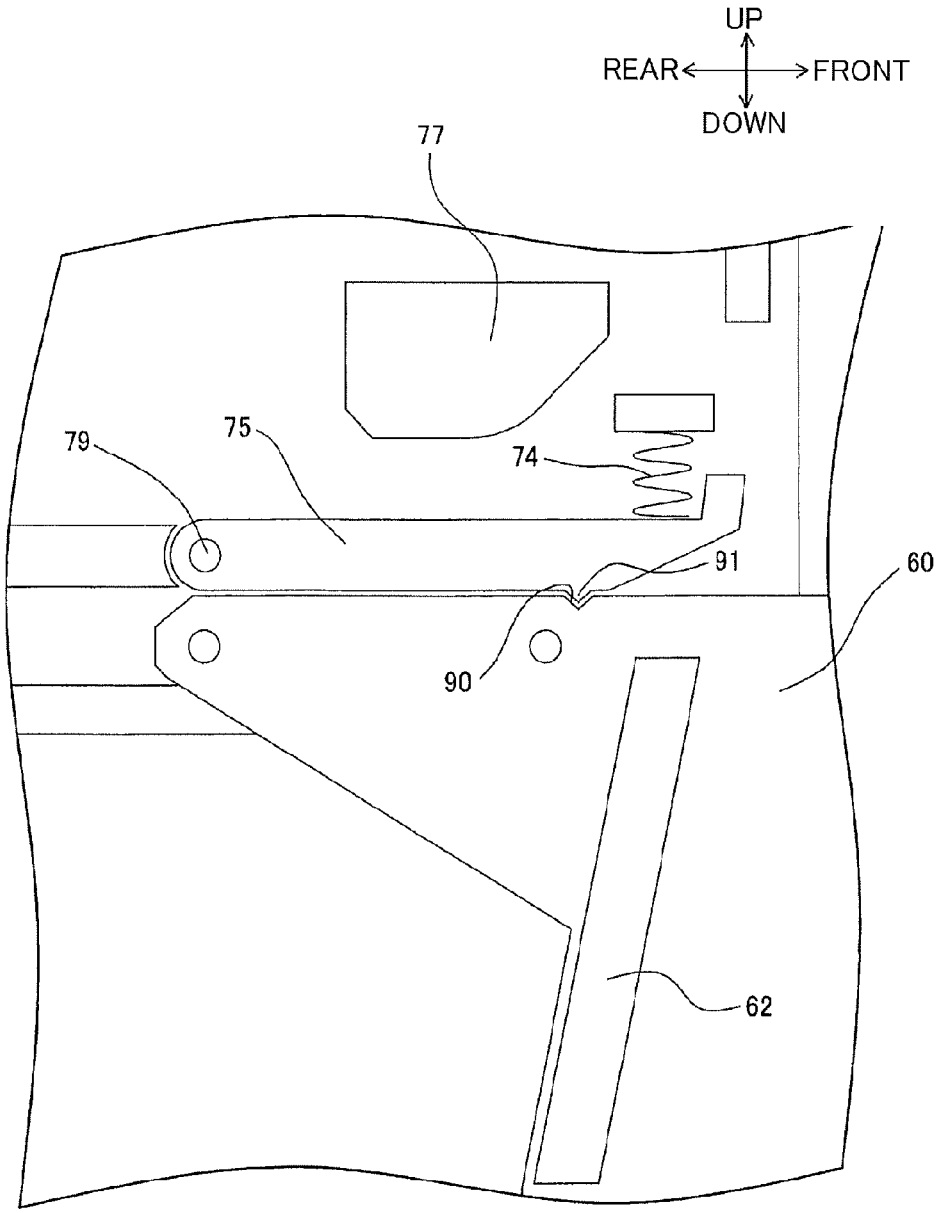
FIG. 11 is a partial enlarged view showing the main body casing and the drum unit.

Further, as shown in FIG. 11, a drum side stopper 90 is formed on the rear side portion of the drum side plate 60. The drum side stopper 90 is formed in a triangle shape in a lateral view by cutting off the upper edge of the drum side plate 60.

As shown in FIG. 5, a drum hand grip 63 is provided on the front beam 61. The drum hand grip 63 is pivotally provided about a pivot shaft 64 provided at the front beam 61 between a proximity position (see FIG. 1) proximal to the front beam 61 and a separate position separated from the front beam 61. When the drum hand grip 63 is in the separate position, the drum hand grip 63 can be gripped so as to slide the drum unit 4 with respect to the main body casing 2 (see FIG. 1).

4. Configuration of Main Body Casing

Figure 6:
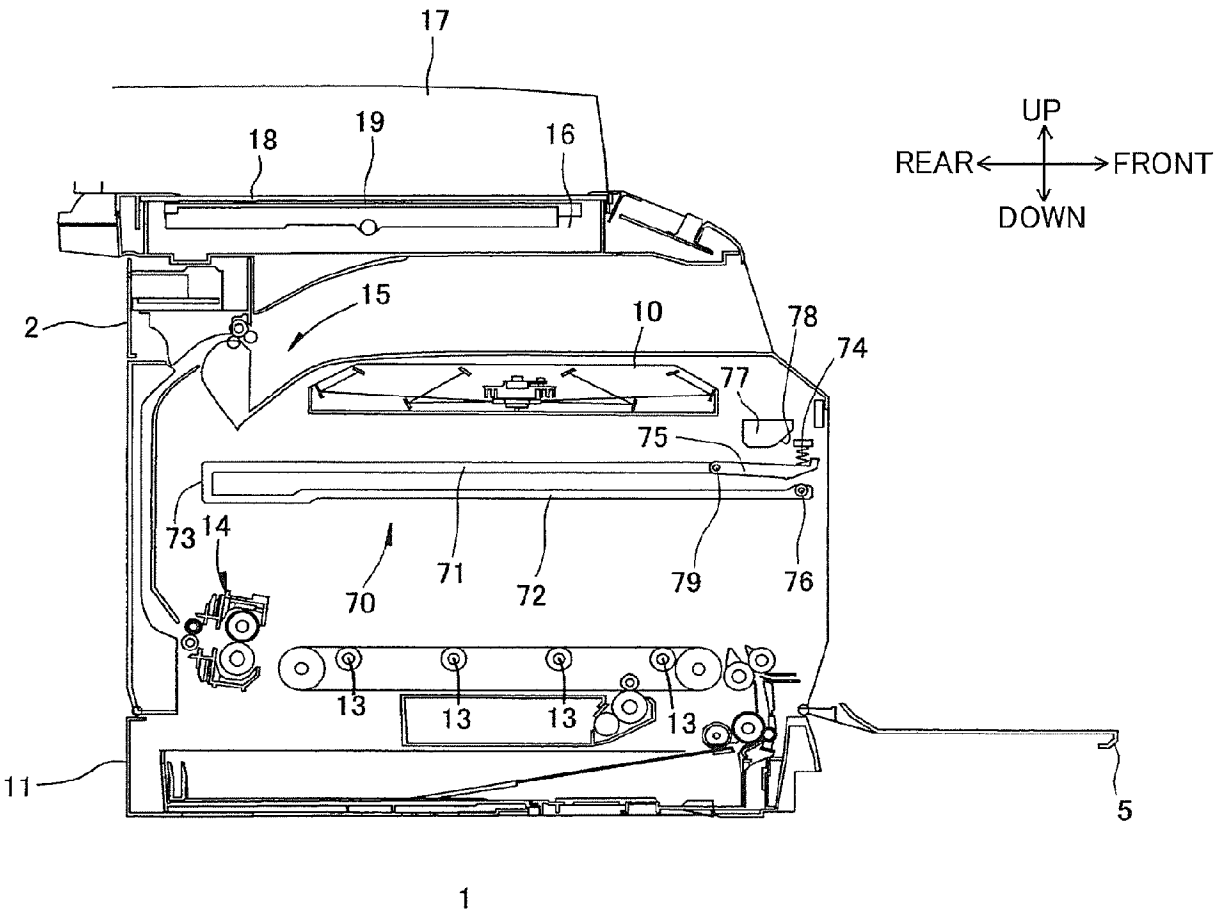
FIG. 6 is a cross-sectional view showing the printer in a state that the drum unit is detached from a main body casing.

As shown in FIG. 6, the main body casing 2 is provided with a pair of rails 70 extending in the front-to-rear direction and each provided at each side wall of the main body casing 2. When the drum unit 4 is located at the accommodated position (see FIG. 1), each of the rails 70 is in confrontation with the flange part (not shown) provided on the drum side plate 60 (see FIG. 5) in the left-to-right direction.

The rail 70 is integrally provided with an upper side portion 71, a lower side portion 72, and a rear side portion 73.

The upper side portion 71 extends in the front-to-rear direction. The upper side portion 71 serves as a second supporting portion for supporting the drum unit 4 when the drum unit 4 is pulled out from and accommodated in the main body casing 2.

At the front end portion of the upper side portion 71, a swing portion 75 is attached through a swing shaft 79 extending in the left-to-right direction. The swing portion 75 extends from the front end portion of the upper side portion 71 toward the front side thereof. Further, an urging member 74 is attached to the front end portion of the swing portion 75. This urging member 74 urges the front end portion of the swing portion 75 downward.

Further, as shown in FIG. 11, a main body side stopper 91 is provide on the front end portion of the swing part 75. The main body side stopper 91 projects downward from the lower edge of the swing portion 75 and is formed in a triangle shape in the lateral view. When the drum unit 4 is in the pulled out position, the main body side stopper 91 is engaged with the drum side stopper 90 formed on the drum side plate 60.

The lower side portion 72 is in confrontation with the upper side portion 71 and the swing portion 75 from below throughout the front-to-rear direction. The lower side portion 72 includes a front section, an intermediate section, and a rear section. The rear section of the lower side portion 72 is lowered by one step from the intermediate section of the lower side portion 72 so as to form a crank shape. Further, the front section of the lower side portion 72 is raised by one step from the intermediate section of the lower section. A roller 76 as a first supporting portion is attached to the front section of the lower side portion 72.

The rear side portion 73 extends in the vertical direction and connects the rear end portion of the upper side portion 71 and the rear end portion of the lower side portion 72.

Further, at a position slightly rearward of the roller member 76, an interference member 77 is provided above the swing portion 75. An inclined surface 78 is formed at the front end portion of the interference member 77. The inclined surface 78 extends from a midway portion of the interference member 77 in the vertical direction toward diagonally downward and rearward.

5. Operations for Mounting Toner Cartridge onto Developing Frame

The toner cartridge 21 is mounted on the developing frame 20 in such a state that the drum unit 4 is in the pulled out position where the drum unit 4 is pulled out from the main body casing 2. In this state, as shown in FIG. 11, the main body side stopper 91 provided on the swing portion 75 is engaged with to the drum side stopper 90 formed on the drum side plate 60 from above. Thereby, the drum unit 4 is held on the main body casing 2 at the pulled out position.

Figure 7:
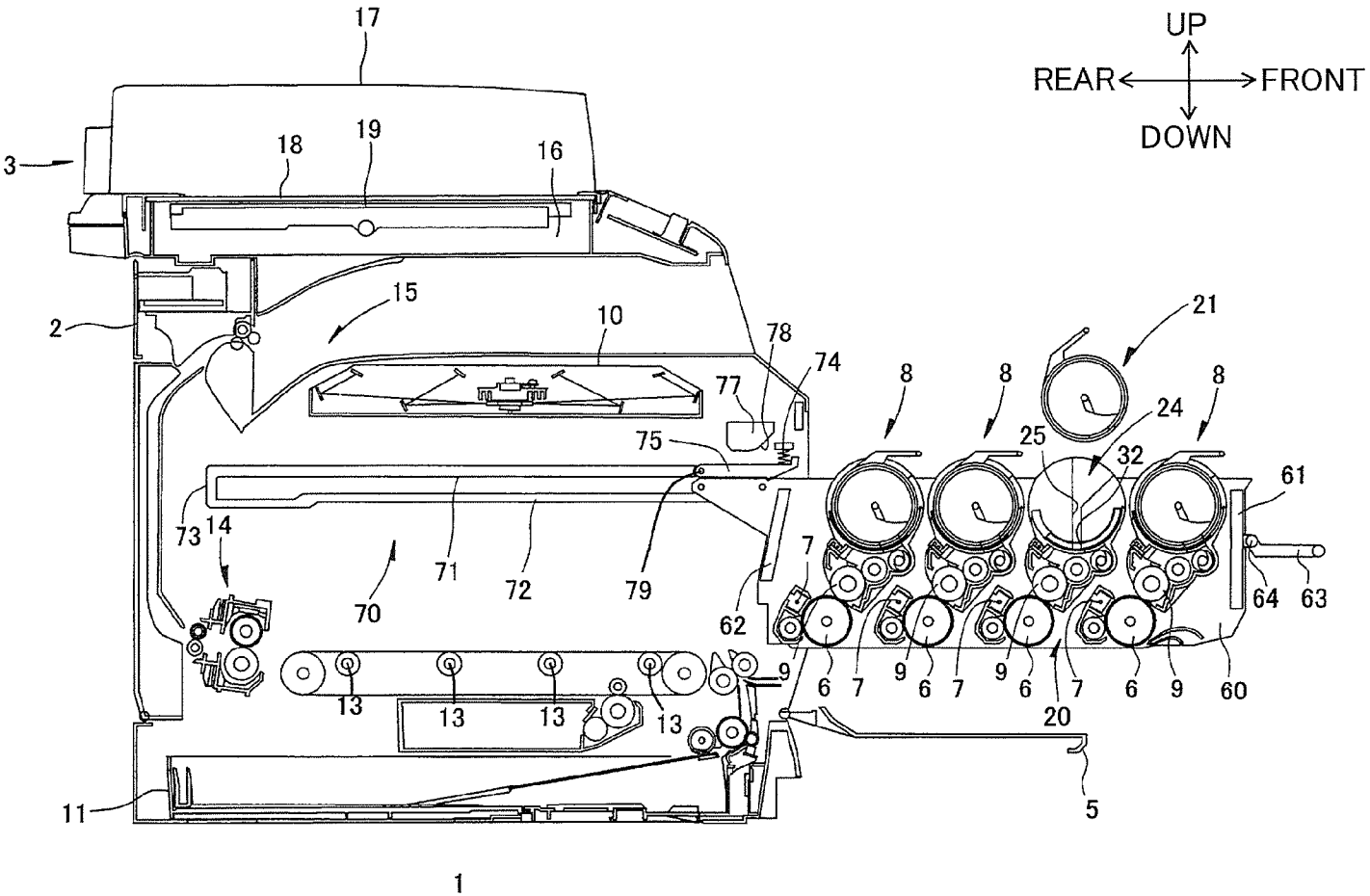
FIG. 7 is a side cross-sectional view showing the printer in a state that one toner cartridge is detached from the developing frame.

As shown in FIG. 7, the toner cartridge 21 is positioned above the developing frame 20 in a state that the grip portion 50 is gripped by a user. In this state, the first shutter 29 of the developing frame 20 is located at the block position shown in FIG. 3A. The second shutter 41 of the toner cartridge 21 is also located at the block position shown in FIG. 4A. Further, the regulating protrusion 44 is aligned with the engaging protrusion 48 in the radial direction of the main body portion 40

Then, the toner cartridge 21 is moved toward the cartridge mounting region 39. The regulating protrusion 44 and the engaging protrusion 48 are guided along the mounting guide portion 24 downward, the regulating protrusion 44 enters the extending portion 25 of the mounting guide portion 24, and the engaging protrusion 48 enters the notched portion 32 of the first shutter 29. Thereby, while the first shutter 29 is interlocked with the second shutter 41, movement of the main body portion 40 of the toner cartridge 21 in the circumferential direction is regulated by the extending portion 25. In this state, the grip portion 50 is located at a second position shown in FIG. 8. When the grip portion 50 is located at the second position, the grip portion 50 stands with respect to the developing frame 20 and the connecting portion 52 is separated away from the developing frame 20. When the grip portion 50 is in the second portion, the grip portion 50 is in confrontation with the interference member 70 in the front-to-rear direction. Further, in this state, the first communication openings 28 are in confrontation with the second communication openings 42 in the radial direction of the main body portion 40.

After that, the grip portion 50 is operated to rotate the connecting portion 52 (tip portion) so as to move frontward. Then, in conjunction with the grip portion 50, the second shutter 41 is moved (rotated) from the block position to the open position. Since the second shutter 41 is interlocked with the first shutter 29 through the engaging protrusion 48 and the notched portion 32, the first shutter 29 also moves from the block position to the open position with the movement of the second shutter 41. At this time, the ribs 31 of the first shutter 29 move along the slide guide portions 23, respectively.

The engaging protrusion 48 also moves in the slide guide portion 23 by the movement of the second shutter 41 while the engaging protrusion 48 enters the notched portions 32. Therefore, with the movement of the first shutter 29 and the second shutter 41, the notched portion 32 is moved to a position not confronting the mounting guide portion 24, and then, the inwardly movement of the engaging protrusion 48 in the radial direction is regulated by the frame side plate 22 and the slide guide portion. As a result, disengagement of the toner cartridge 21 from the developing frame 20 is regulated.

After that, the first shutter 29 and the second shutter 41 are located at the open position. Then, as shown in FIG. 2, while the first communication openings 28 are in confrontation with the first shutter openings 30, the second communication openings 42 are in confrontation with the second shutter openings 47. As a result, the containing chamber 45 of the toner cartridge 21 communicates with the developing chamber 35 in the developing frame 20 through the second communication openings 42, the second shutter openings 47, the first shutter openings 30, and the first communication openings 28. In this state, the toner in the main body portion 40 can be supplied to the developing chamber 35 through the openings 42, 47, 30, and 28. Then, the mounting of the toner cartridge 21 on the developing frame 20 is completed. At this time, the grip portion 50 is located at a first position. The grip portion 50 in the first position is more inclined than the grip portion 50 in the second position with respect to the vertical direction. When the grip portion 50 is in the first position, the grip portion 50 does not confront the interference member 77 in the front-to-rear direction.

6. Operations for Accommodating Drum Unit in Main Body Casing

Figure 8:
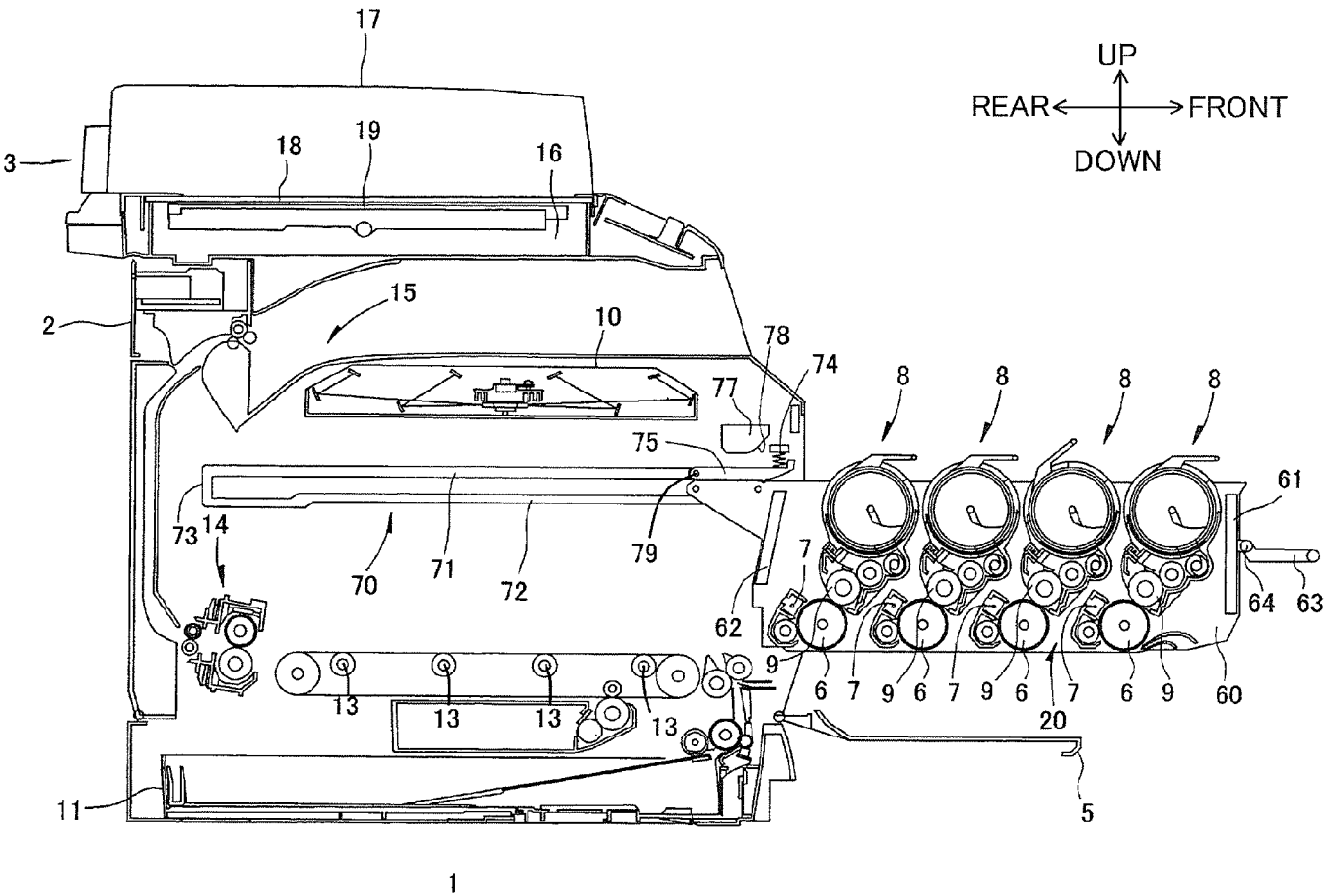
FIG. 8 is a side cross-sectional view showing the printer in a state that the second shutter of one toner cartridge is located at the block position.

As shown in FIG. 8, operations for accommodating the drum unit 4 in the main body casing 2 are performed in a state that the front cover 5 is opened.

When the drum unit 4 is located at the pulled out position, the rear end portion of the flange portion (not shown) of the drum side plate 60 is positioned at the front end portion of the rail 70. In this state, the rear end portion of the flange portion abuts the upper side portion 71 of the rail 70 from below. In other words, a part of the upper side portion 71 that abuts the roller (not shown) provided at the rear end portion of the flange portion serves holding the drum unit 4. Further, a midway portion of the flange portion abuts the roller 76 provided at the lower side portion 72 of the rail 70 (see FIG. 6) from above. As shown in FIG. 6, the swing portion 75 is urged downward by the urging member 74. Therefore, the midway portion of the flange portion is pressed downward through the swing portion 75.

At this time, as shown in FIG. 11, the main body side stopper 91 provided at the swing portion 75 is engaged with the drum side stopper 90 formed on the drum side plate 60 from above. Thereby, when the drum unit 4 is located at the pulled out position, the drum unit 4 is held by the main body casing 2. The drum unit 4 is not moved from the pulled out position without applying a sufficient force to disengage the main body side stopper 91 from the drum side stopper 90.

When the first shutter 29 and the second shutter 41 are located at the open position, and when the grip portion 50 is located at the first position, the grip portion 50 is not in confrontation with the interference member 77 provided in the main body casing 2 in the front-to-rear direction. In other words, the grip portion 50 located at the first position is out of alignment with the interference member 77 in the front-to-rear direction. Therefore, the drum unit 4 is moved rearward to abut the rear end part of the flange portion (the drum side plate 60) on the rear side portion 73 of the rail 70 in a state that the mounting of all the toner cartridges 21 are completed and that the first shutter 29 and the second shutter 41 are located at the open position. The rearward movement of the drum unit 4 is regulated by abutting the rear end part of the flange portion on the rear side portion 73. Thereby, the drum unit 4 is accommodated in the main body casing 2 and is located at the accommodated position.

On the other hand, if the first shutter 29 and the second shutter 41 are located at the block position without operating the grip portion 50 of any one of the toner cartridges 21 (see FIGS. 8 and 9), the unoperated grip portion 50 is located at the second position, thereby confronting the interference member 77 in the front-to-rear direction.

Figure 9:
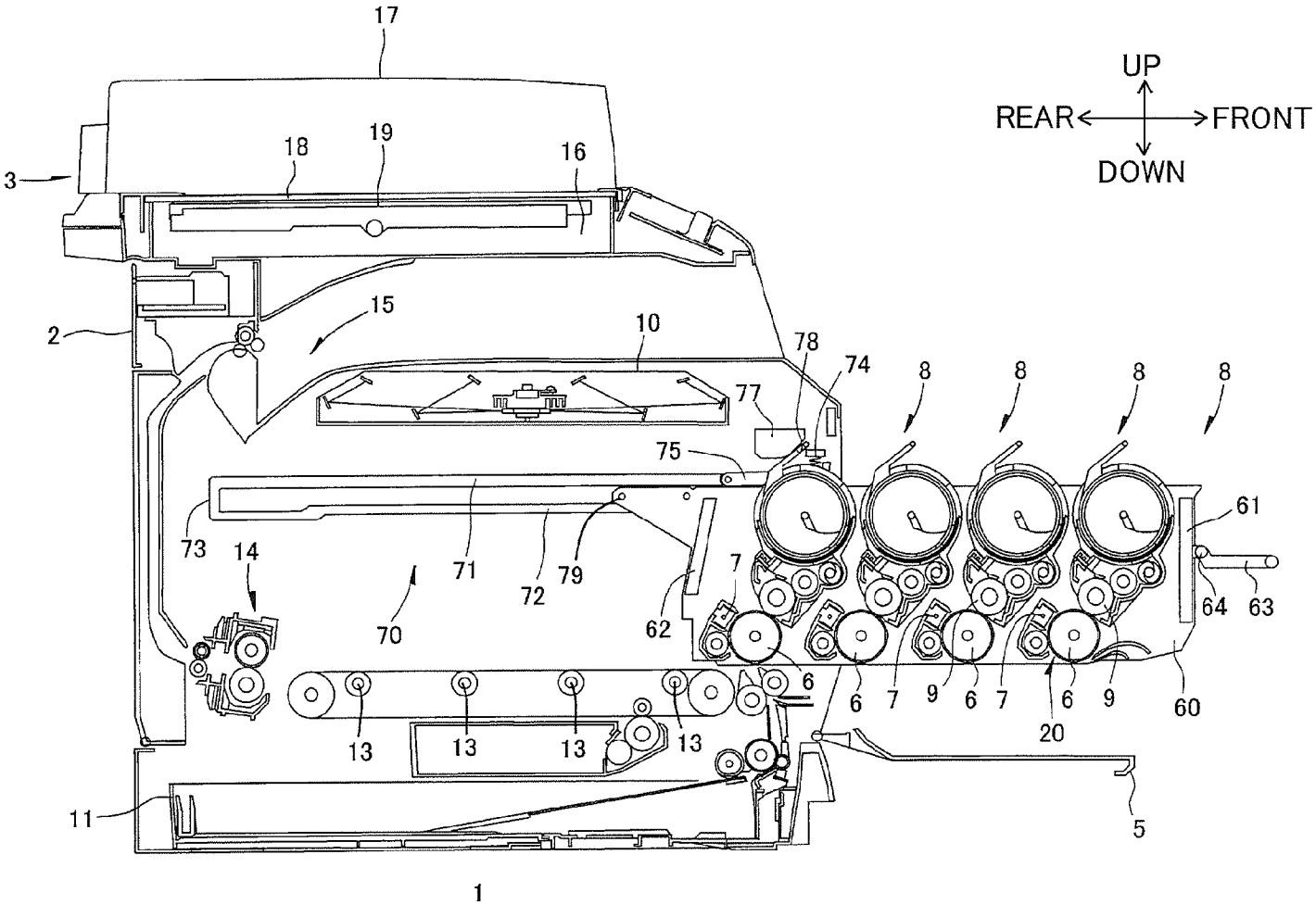
FIG. 9 is a side cross-sectional view showing a state of the drum unit on the way to be accommodated in the main body casing.

Then, by moving the drum unit 4 backward, as shown in FIG. 9, the unoperated grip portion 50 located at the second position abuts the inclined surface 78 of the interference member 77 from the front side. After that, the drum unit 4 is moved further backward, and then, a force is applied to the unoperated grip part 50 from the inclined surface 78. Therefore, the connecting portion 52 (tip end) of the unoperated grip portion 50 is moved frontward.

Figure 10:
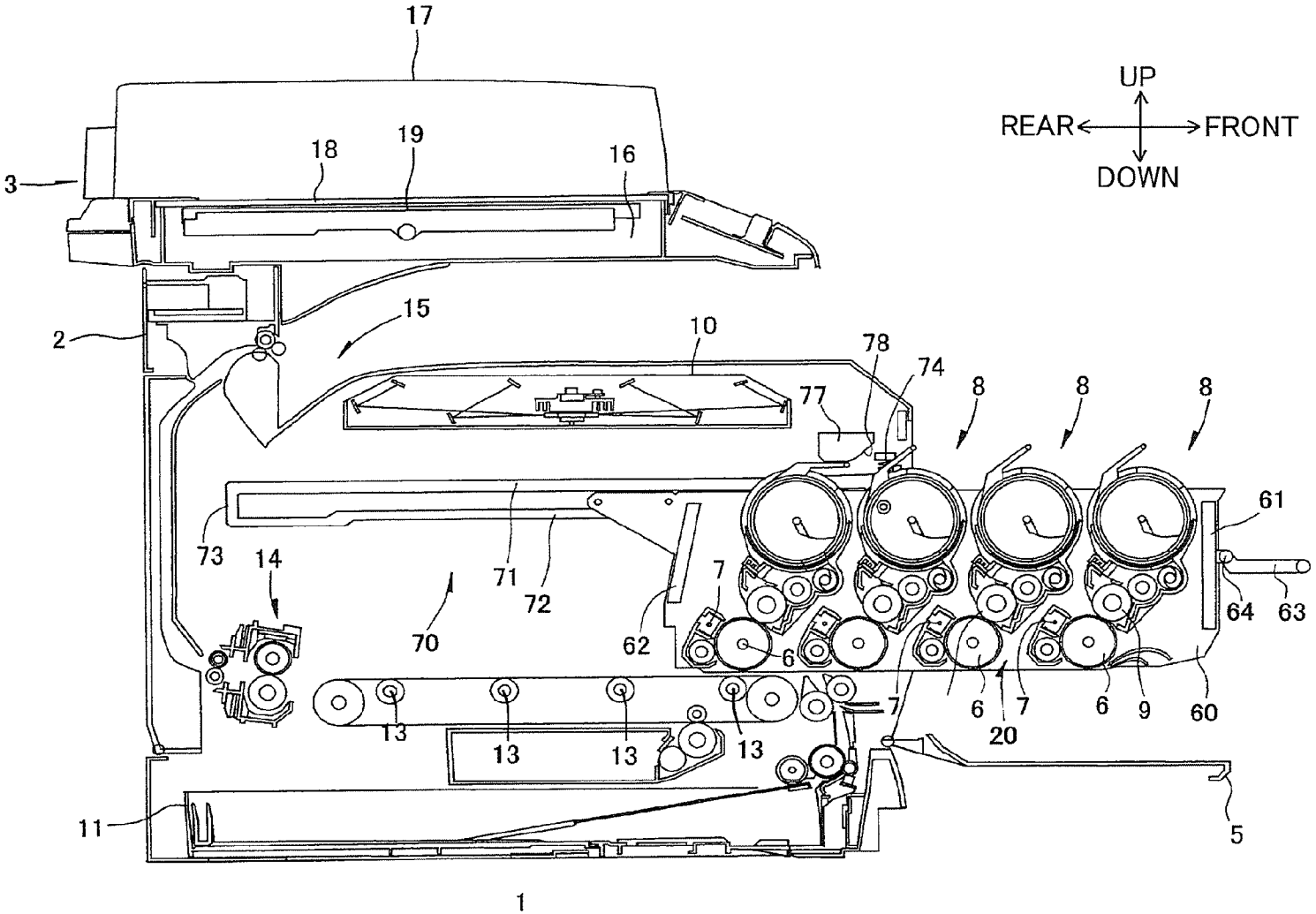
FIG. 10 is a side cross-sectional view showing a state of the drum unit after the state of the drum unit shown in FIG. 9.

Thereby, as shown in FIG. 10, the first shutter 29 and the second shutter 41 are moved to the open position with being moved the grip portion 50 to the first position.

7. Operation and Effect

As described above, the drum unit 4 is provided so as to be movable between the accommodated position where the drum unit 4 is accommodated in the main body casing 2 and the pulled out position where the drum unit 4 is pulled out from the main body casing 2. The plurality of photosensitive drums 6 and the plurality of toner cartridges 8 are held in the drum unit 4. The plurality of photosensitive drums 6 are juxtaposed with one another with an interval between neighboring photosensitive drums 6. Each of the toner cartridges 8 is provided on the corresponding photosensitive drum 6.

When the drum unit 4 is in the pulled out position, the toner cartridge 21 is detachably mounted on the developing frame 20. The second communication openings 42 for supplying the toner in the main body portion 40 to the developing roller 9 is formed on the main body portion 40 at a position confronting the first communication openings 28 of the developing frame 20 in a state that the toner cartridge 21 is mounted on developing frame 20. Further, the toner cartridge 21 is provided with the second shutter 41. The second shutter 41 is provided so as to be movable between the open position where the second shutter 41 opens the second communication openings through the second shutter openings 47 and the block position where the second shutter 41 blocks the second communication openings 42. The grip portion 50 is connected to the second shutter 41. The grip portion 50 is movable between the first position and the second position to thereby locate the second shutter 41 at the open position and the block position, respectively.

The main body casing 2 is provided with the interference member 77. When the drum unit 4 is moved from the pulled out position to the accommodated position, the interference member 77 abuts the grip portion 50 and displaces each grip portion 50 from the second position to the first position with movement of the drum unit 4 after the abutting.

Therefore, even if the drum unit 4 is moved from the pulled out position to the accommodated position in a state that the second communication openings 42 is blocked by the second shutter 41 (i.e. the grip portion 50 is in the second position), each grip portion 50 is displaced from the second position to the first position by the interference member 77. In other words, the second shutter 41 is moved from the block position and the open position as the drum unit is moved from the pulled out position to the accommodated position. Therefore, after the toner cartridge 21 having the second communication openings 42 blocked by the second shutter 41 is mounted on the drum unit 4, even if a user does not operate the grip portion 50 to displace from the second position to the first position (i.e. the user does not operate the grip portion 50 to open the second shutter 41), the toner cartridge 21 can be certainly prevented from being accommodated in the main body casing 2 in a state that the second communication openings 42 is blocked by the second shutter 41.

Further, the interference member 77 is located at a position not confronting the grip portion 50 in the first position but confronting the grip portion 50 in the second position in the front-to-rear direction. Therefore, the grip portion 50 in the first position does not abut the interference member 77 and does not block the movement of the drum unit 4. Thus, since the second shutter 41 of each of the toner cartridges 21 can be opened certainly with the movement of the drum unit 4 from the pulled out position to the accommodated position, smooth movement of the drum unit 4 can be ensured.

Further, the sealing member for preventing the toner from spilling at the periphery of the second communication openings 42 and the second shutter openings 47 is inserted between the main body portion 40 and the second shutter 41 of the toner cartridge 21 in a compressed state. Due to friction among the sealing member, the main body portion 40, and the second shutter 41, a large force is necessary to move the second shutter 41 between the block position and the open position. Therefore, when the second shutter 41 is moved from the block position to the open position in a state that the drum unit 4 is located at the pulled out position, the printer 1 may be inclined to the front side by applying a downward force to a front section of the drum unit 4.

Thus, in this embodiment, the first position of the grip portion 50 is located upstream (front side) of the second position of the grip portion 50 in a direction that the drum unit 4 is moved from the pulled out position to the accommodated position. Thereby, a direction that the grip portion 50 is moved from the first position to the second position is substantially the same as the direction that the drum unit 4 is moved from the pulled out position to the accommodated position. That is, when the drum unit 4 is located at the pulled out position, a direction of the force applied to the grip portion 50 for moving the grip portion 50 from the first position to the second position is opposite to a direction that the front section of the drum unit 4 is moved downward. Therefore, when the grip portion 50 is moved from the first position to the second position to move the second shutter 41 to the block position in a state that the drum unit 4 is located at the pulled out position, the printer 1 can be prevented from being inclined to the pulled out position side of the drum unit 4.

Further, when the grip portion 50 is located at the second position, the grip portion 50 is in a standing state with respect to the main body portion 40. Then, the grip portion 50 is displaced from the second position to the first position by being inclined from the standing state to the upstream side in the direction that the drum unit 4 is moved from the pulled out position to the accommodated position. Therefore, when the grip portion 50 is displaced from the first position to the second position to move the second shutter 41 to the block position, a downward force is not applied to the grip portion 50. As a result, the printer 1 can be further prevented from being inclined.

Further, since the grip portion 50 is in the standing state with respect to the main body part 40 at the second position, the standing grip portion 50 can be gripped easily when the toner cartridge 21 is attached to and detached from the developing frame 20.

Further, when the second shutter 41 is in the open position, disengagement of the toner cartridge 21 from the drum unit 4 is regulated by the slide guide portions 23. Thereby, the toner cartridge 21 can be prevented from being disengaged from the drum unit 4 in a state the second shutter 41 is in the open position. Thus, when the toner cartridge 21 is disengaged from the drum unit 4, the toner can be surely prevented from spilling from the toner cartridge 21 through the second communication openings 42.

The main body casing 2 is provided with the roller member 76 and the rail 70 (upper side portion 71) with a space therebetween in the front-to-rear direction. The drum unit 4 is supported by the roller member 76 and the rail 70 (upper side portion 71). The interference member 77 is located between the roller members 76 and the upper side portion 71 in the front-to-rear direction. Thereby, when the interference member 77 abuts the grip portion 50, a force applied from the interference member 77 to the grip part 50, is transferred to the drum unit 4 through the developing frame 20 of the toner cartridge 8, and is received at two points of the roller member 76 and the upper side portion 71. Thus, when the interference member 77 abuts the grip part 50, the drum unit 4 can be prevented from dropping off the main body casing 2, and the printer 1 can be prevented from being inclined by losing its weight balance.

Further, the drum unit 4 is provided with the drum hand grip 63 gripped for moving the drum unit 4 between the pulled out position and the accommodated position. Since the drum hand grip 63 is gripped by a user when the drum unit 4 is moved, the printer 1 can be certainly prevented from being inclined during the movement of the drum unit 4. Furthermore, when the drum unit 4 is moved from the pulled out position to the accommodated position, the interference member 77 abuts the grip portion 50 of the toner cartridge 21. In this state, since the drum hand grip 63 is gripped by the user, the printer 1 can be surely prevented from being inclined when the second shutter 41 is opened by abutting the interference member 77 with the grip portion 50.

Further, the main body side stopper 91 is provided at the front end part of the swing portion 75. When the drum unit 4 is located at the pulled out position, the main body side stopper 91 is engaged with the drum side stopper 90 formed on the drum side plates 60. Therefore, when the second shutter 41 is moved to the open position, the drum unit 4 does not move by a force applied to the grip portion 50. Therefore, the printer 1 can be further prevented from being inclined.

8. Modified Embodiment

While the invention has been described in detail with reference to specific embodiments thereof, it would be apparent to those skilled in the art that many modifications and variations may be made therein without departing from the spirit of the invention, the scope of which is defined by the attached claims.

For example, the toner cartridge 21 can be attached to and detached from the developing frame 20, but may be provided so as to be capable of being attached to and detached from the drum side plates 60 of the drum unit 4. In this case, a guide portion for guiding the toner cartridge 21 to the corresponding developing frame 20 is provided at the inner side surface of the drum side plates 60. Hence, each of the toner cartridges 21 can be replaced in relation to the corresponding developing frame 20.

Further, in the above embodiment, on the assumption that an operator opens and closes the second shutter 41 manually, the grip portion 50 is formed in the U-shape protruding from the peripheral surface of the main body portion 40 of the toner cartridge 21. Hence, the operator can easily operate the toner cartridge 21.

However, on the assumption that the operation of the grip portion 50 is performed by contacting the interference member 77 with the grip portion 50, the toner cartridge 21 may be configured so as to smoothly operate the grip portion 50 by abutting the interference member 77.

For example, instead of the U-shaped grip portion 50, a grip portion for operating the second shutter 41 may also be formed in a plate shape extending from the circumferential surface of the main body portion 40. Thereby, the stiffness of the grip portion 50 is increased. Therefore, when the grip portion 50 receives a force by abutting the interference member 77, smoothly operation of the second shutter 41 can be achieved.

In this case, since it is not assumed that the operator operates the grip portion 50, the possibility that the printer 1 is inclined by applying an unnecessary force to the drum unit 4 can be considerably reduced.

What is claimed is:

1. An image forming apparatus comprising:

a main body casing;

a holder configured to move between an accommodated position where the holder is accommodated in the main body casing and a pulled out position where the holder is pulled out from the main body casing;

a plurality of photosensitive drums held by the holder and juxtaposed with each other with an interval between neighboring photosensitive drums;

a plurality of developing units held by the holder and each corresponding to each photosensitive drum to develop the corresponding photosensitive drum; and a plurality of toner cartridges configured to be attached to the holder when the holder is in the pulled out position, each of the plurality of toner cartridges corresponding to one of the plurality of developing units to supply toner, each of the toner cartridges comprising:

a case configured to contain the toner therein and having an opening at a position confronting the corresponding developing unit in a state that the toner cartridge is attached to the holder;

a shutter movable between a block position where the shutter blocks the opening and an open position where the shutter opens the opening; and an operation member for operating the shutter such that the shutter moves between the block position and the open position, the shutter being located at the open position when the operation member is located at a first position, the shutter being located at the block position when the operation member is located at a second position different from the first position, the operation member having:

a base end fixed to the shutter; and a distal end configured to move from a lower position to a higher position higher than the lower position when the operation member is moved from the first position to the second position, wherein the holder is configured to move in a moving direction directed from the pulled out position to the accommodated position, wherein, for each of the plurality of toner cartridges, a direction directed from the base end to the distal end is parallel to the moving direction when the operation member is located in the first position, and wherein, for each of the plurality of toner cartridges, the distal end is located at a position higher than the base end when the operation member is located in the second position.

2. The image forming apparatus according to claim 1, wherein the operation member of each of the plurality of toner cartridges is capable of moving between the first position and the second position when the holder is in the pulled out position.

3. The image forming apparatus according to claim 1, further comprises an exposure unit disposed above the holder in the main body casing and configured to emit beams toward the photosensitive drums, the exposure unit extending in the moving direction, wherein the operation member of each of the plurality of toner cartridges has a supporting portion extending from the base end to the distal end, the supporting portion opposing the exposing unit and extending in parallel to the exposing unit when the holder is accommodated in the main body casing.

4. The image forming apparatus according to claim 1, wherein the operation member of each of the plurality of toner cartridges that is located at the second position is in a standing state with respect to the case, the operation member of each of the plurality of toner cartridges being displaced from the second position to the first position by being inclined from the standing state to an upstream side in the moving direction.

5. The image forming apparatus according to claim 4, wherein, for each of the plurality of toner cartridges, the operation member is configured to serve as a grip portion gripped by a user when the toner cartridge is attached to or detached from the holder in a state that the operation member is located at the second position.

6. The image forming apparatus according to claim 1, wherein, for each of the plurality of toner cartridges, the distal end of the operation member at the first position is located upstream of the distal end of the operation member at the second position in the moving direction.

7. The image forming apparatus according to claim 1, further comprising an interference member configured such that the operation members abut the interference member to be displaced from the second position to the first position when the holder is moved from the pulled out position to the accommodated position.

8. The image forming apparatus according to claim 7, wherein the interference member is out of alignment with the operation member located at the first position in the moving direction and is in confrontation with the operation member located at the second position in the moving direction.

9. The image forming apparatus according to claim 7, wherein the main body casing is provided with a first supporting portion and a second supporting portion with a space therebetween in the moving direction, the first supporting portion and the second supporting portion configured to support the holder with respect to the main body casing, the interference member being located between the first supporting portion and the second supporting portion in the moving direction.

10. The image forming apparatus according to claim 1, further comprising a regulating member configured to regulate disengagement of the toner cartridge from the holder when the shutter is located at the open position.

11. The image forming apparatus according to claim 1, wherein the holder is provided with a hand grip gripped by a user when the holder is moved between the accommodated position and the pulled out position.

12. The image forming apparatus according to claim 1, wherein the main body casing includes a first stopper and the holder includes a second stopper, wherein, when the holder is located at the pulled out position, the first stopper is engaged with the second stopper for holding the holder located at the pulled out position with respect to the main body casing.

13. An image forming apparatus comprising:

a main body casing;

a holder configured to move between an accommodated position where the holder is accommodated in the main body casing and a pulled out position where the holder is pulled out from the main body casing;

a plurality of photosensitive drums held by the holder and juxtaposed with each other with an interval between neighboring photosensitive drums;

a plurality of developing units held by the holder and each corresponding to each photosensitive drum to develop the corresponding photosensitive drum;

a plurality of toner cartridges configured to be attached to the holder when the holder is in the pulled out position, each of the plurality of toner cartridges corresponding to one of the plurality of developing units to supply toner, each of the toner cartridges comprising:

a case configured to contain the toner therein and having an opening at a position confronting the corresponding developing unit in a state that the toner cartridge is attached to the holder;

a shutter movable between a block position where the shutter blocks the opening and an open position where the shutter opens the opening; and an operation member for operating the shutter such that the shutter moves between the block position and the open position, the shutter being located at the open position when the operation member is located at a first position, the shutter being located at the block position when the operation member is located at a second position different from the first position, the operation member having:

a base end fixed to the shutter; and a distal end configured to move from a lower position to a higher position higher than the lower position when the operation member is moved from the first position to the second position; and an interference member configured such that the operation members abut the interference member to be displaced from the second position to the first position when the holder is moved from the pulled out position to the accommodated position.

14. The image forming apparatus according to claim 13, wherein the operation member of each of the plurality of toner cartridges is capable of moving between the first position and the second position when the holder is in the pulled out position.

15. The image forming apparatus according to claim 13, further comprises an exposure unit disposed above the holder in the main body casing and configured to emit beams toward the photosensitive drums, the exposure unit extending in the moving direction, wherein the operation member of each of the plurality of toner cartridges has a supporting portion extending from the base end to the distal end, the supporting portion opposing the exposing unit and extending in parallel to the exposing unit when the holder is accommodated in the main body casing.

16. The image forming apparatus according to claim 13, wherein the operation member of each of the plurality of toner cartridges that is located at the second position is in a standing state with respect to the case, the operation member of each of the plurality of toner cartridges being displaced from the second position to the first position by being inclined from the standing state to an upstream side in a moving direction directed from the pulled out position to the accommodated position, wherein, for each of the plurality of toner cartridges, a direction directed from the base end to the distal end is parallel to the moving direction when the operation member is located in the first position, and wherein, for each of the plurality of toner cartridges, the distal end is located at a position higher than the base end when the operation member is located in the second position.

17. The image forming apparatus according to claim 16, wherein, for each of the plurality of toner cartridges, the operation member is configured to serve as a grip portion gripped by a user when the toner cartridge is attached to or detached from the holder in a state that the operation member is located at the second position.

18. The image forming apparatus according to claim 13, wherein, for each of the plurality of toner cartridges, the distal end of the operation member at the first position is located upstream of the distal end of the operation member at the second position in a moving direction directed from the pulled out position to the accommodated position, wherein, for each of the plurality of toner cartridges, a direction directed from the base end to the distal end is parallel to the moving direction when the operation member is located in the first position, and wherein, for each of the plurality of toner cartridges, the distal end is located at a position higher than the base end when the operation member is located in the second position.

19. The image forming apparatus according to claim 13, wherein the interference member is out of alignment with the operation member located at the first position in the moving direction and is in confrontation with the operation member located at the second position in the moving direction.

20. The image forming apparatus according to claim 13, wherein the main body casing is provided with a first supporting portion and a second supporting portion with a space therebetween in the moving direction, the first supporting portion and the second supporting portion configured to support the holder with respect to the main body casing, the interference member being located between the first supporting portion and the second supporting portion in the moving direction.

21. The image forming apparatus according to claim 13, further comprising a regulating member configured to regulate disengagement of the toner cartridge from the holder when the shutter is located at the open position.

22. The image forming apparatus according to claim 13, wherein the holder is provided with a hand grip gripped by a user when the holder is moved between the accommodated position and the pulled out position.

23. The image forming apparatus according to claim 13, wherein the main body casing includes a first stopper and the holder includes a second stopper, wherein, when the holder is located at the pulled out position, the first stopper is engaged with the second stopper for holding the holder located at the pulled out position with respect to the main body casing.

* * * * *